United States Patent [19]

Short et al.

[11] Patent Number: 4,775,350

[45] Date of Patent: Oct. 4, 1988

[54] TAKE APART TOY STRUCTURE

[76] Inventors: Roy M. Short, R.R. #2, Box 108; Nelson L. Chase, R.R. #2, Box 322, Road 600 South, both of Lynn, Ind. 47355

[21] Appl. No.: 548,153

[22] Filed: Nov. 2, 1983

[51] Int. Cl.[4] ..... A63H 33/12

[52] U.S. Cl. ..... 446/107; 446/123; 446/126

[58] Field of Search ..... 46/29, 28, 27, 16, 17; 446/107, 109, 122, 123, 128, 126, 85

[56] References Cited

U.S. PATENT DOCUMENTS

| | | | |
|---|---|---|---|
| 2,512,725 | 6/1950 | Mock, Jr. | 46/29 X |
| 2,625,769 | 1/1953 | Hubbard | 46/28 X |
| 3,982,754 | 9/1976 | de Moreau | 46/29 X |

FOREIGN PATENT DOCUMENTS

| | | | |
|---|---|---|---|
| 923789 | 7/1947 | France | 46/29 |
| 976196 | 3/1951 | France | 46/16 |
| 1321281 | 6/1973 | United Kingdom | 46/29 |

*Primary Examiner*—Mickey Yu

*Attorney, Agent, or Firm*—J. David Haynes

[57] ABSTRACT

A toy construction kit is provided which includes, as basic building elements, a plurality of tubular elements having transverse throughbores routinely spaced along their length and routinely spaced about their periphery at relative displacements of 30, 45, 60 and 90 degrees. Rod-like elements are also provided for insertion through the transverse bores and may be secured therethrough by bolts screwed into threaded recesses in the ends of the rods. Deformable circular planar connectors are provided to which the rods may be joined through the use of the bolts. A connector has a plurality of flanges or ears about its periphery each of which has a circular opening for permissive joinder of the rods thereto. The rods may eminate from the connector at various angles to thus enable the construction of various geometric forms. Tubular elements are also provided for insertion into the ends of the basic tubular elements to thus join two of those elements into an unitary member; rods are bolted through the assembly to secure the joint.

8 Claims, 4 Drawing Sheets

40
4
10
8
2
4
4
10
8
16
14
20
18

12
14
16
20
18
24
22

24
26
32
28
30

TAKE APART TOY STRUCTURE

BACKGROUND OF THE INVENTION

This invention relates to playground and scaffolding type apparatus and more particularly to apparatus useful in constructing many types of outdoor and indoor play equipment and creative structures as well as other types of three-dimensional structural arrays.

This invention further relates to structural elements of an apparatus which may be dismantled and rearranged as desired into other types of structures using various geometric relationships among the elements of the apparatus, including geodesic designs.

The present invention relates to a toy construction set which will stimulate the ingenuity, imagination and creativity of children. The user will form a mental image of a structure to be built and may then construct such structure which will develop his skill or cleverness in design and model construction. One may readily construct a basic structure and subsequently more complex three-dimensional structures.

PRIOR ART

A wide variety of construction toys or kits have been developed over the years; however, they are primarily small models such as the well-known Tinker Toy sets. Larger units are available for use in constructing large apparatus for use in school and municipal playgrounds as well as backyards for exercise and play. Heretofore, such apparatus was usually constructed of metal or wood in the well-known geometric relationship to form a permanently fixed three-dimensional structure upon which children could climb and upon which swings, slides and other events were suspended. Prior art devices have predominantly been of a solid type of construction which limited the usage of the device to the events originally built into the apparatus. Little or no provision was made for the ingenuity of the participants in the design or function of such apparatus since structural alteration of the apparatus was difficult or impossible once construction of the apparatus was completed. Such apparatus, while occupying the time and having at least some beneficial effects on the participants, did little or nothing toward stimulating the creative thoughts and abilities of the participants. Furthermore, no provision was made to properly accommodate the changing needs of a growing family or community.

U.S. Pat. No. 3,814,416 to Munger et al. provides an apparatus that may be assembled or reassembled into different geometic shapes; however, the variations are limited to right angle construction principles without offering a means whereby various elements thereof may be joined at varying angles or to permit a plurality of elements thereof to join at a common junction.

Yet another example of a prior art play apparatus is disclosed in U.S. Pat No. 2,704,667 to Sanders. While this structure permits its members to have angular relationships one to the other, the angles are predetermined and may not be varied by the user.

SUMMARY OF THE INVENTION

In accordance with this invention, toy construction elements are provided for forming basic composite structural members including geodesic designs and for joining the elements together to form rigid three-dimensional structures. The toy construction elements of the present invention permit their use in the formation of various forms of structural units. The elements of the resulting structures may have myraid relative angular displacement.

Tubular support members are provided which have varied transverse bores or throughbores. Tubular rods may be inserted through these holes and secured therethrough by bolts which screw into threaded recesses in the ends of the rods. The rods may be joined together to form arrays of rods which eminate from their juncture at various angles. The connector which joins or acts to join the rods together is a circular planar plastic member having a series of flanges or ears about the periphery thereof. The flanges or ears have circular holes therethrough which receive a bolt for securing the rods thereto by screwing the bolt into the threaded recesses in the end of the rods. Thus, the rods are joined to a single member which permits the rods to be moved or rotated into myraid angular relationships to thus permit the user to construct varied and unusual structural configurations.

It is an object of the present invention to provide a safe durable and quality support system which will provide an apparatus which may be readily assembled into almost unlimited designs and embodiments for use as play apparatus.

A further object of the present invention is to provide a connector which may be used to join structural members of the present invention into various angular arrays.

It is a further object of the present invention to provide a quality construction toy which will provide a creative building challenge to its user.

Yet a further object of the present invention is to provide a play apparatus which has the inherent capacity to be altered and re-arranged to present varying challenges to a child's growing coordination and muscular development. A related important object is to provide a structural apparatus which has a sufficiently simple method of construction for the user to design and construct his own apparatus from elements which may be readily dismantled and re-arranged by the user to suit particular needs and aspirations.

BRIEF DESCRIPTION OF THE DRAWINGS

In the accompanying drawings forming part of the specification, and in which like numerals are employed to designate like parts throughout the same.

FIG. 5(*b*) is a side view of the star connector of FIG. 5(*a*).

DESCRIPTION OF THE PREFERRED EMBODIMENT

Figures 1, 2, 3, 6, 9:
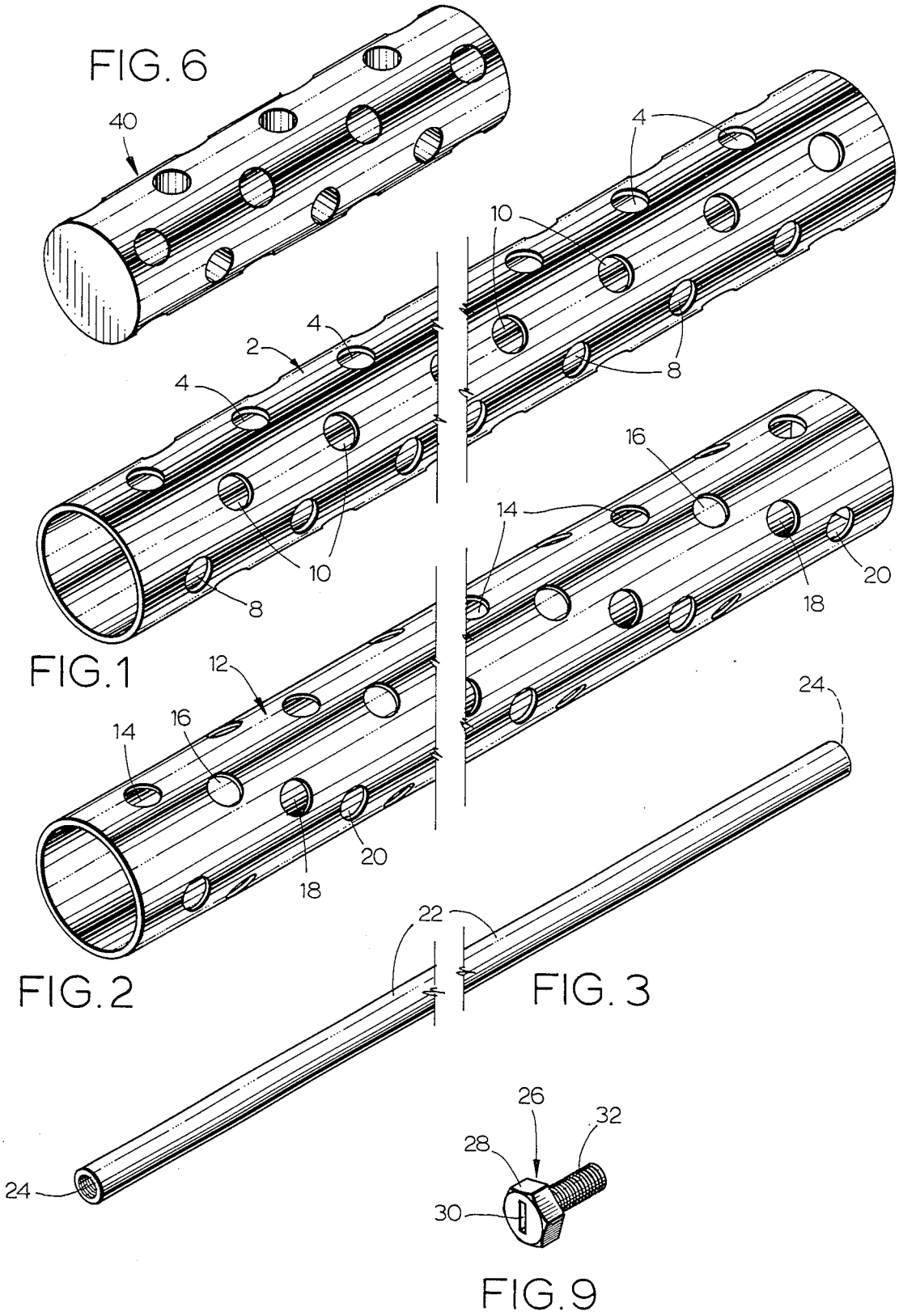
FIG. 1 is a perspective view of a tubular support member having transverse bores or thoughbores.
FIG. 2 discloses yet another tubular support member having transverse bores or throughbores.
FIG. 3 is a perspective view of a rod-like structural memter having recessed threaded portions on each end.
FIG. 6 discloses a tubular structural member for use in oining other tubular structural members into a unitary member.
FIG. 9 is a bolt for use in joining the rods of FIG. 3 to the other elements of this invention.

While this invention is susceptible of embodiment in many different forms, there are shown in the drawings and will here be described in detail preferred embodiments of the invention. It should be understood, however, that the present disclosure is to be considered as an exemplification of the principles of the invention and is not intended to limit the invention to the embodiments illustrated.

The precise shapes and sizes of the components herein described are not essential to the invention unless otherwise indicated, since the invention is described with only reference to embodiemts which are simple and straight forward.

Referring now to FIG. 1 there is disclosed a perspective view of a tubular support element according to the present invention. A plurality of tubular members 2 are used or may be used in constructing a structure. Tubular members 2 are of a length determined by the user. Transverse bores or throughbores 4 are spaced at regular intervals along the length of tubular member 2. Transverse bores 4 pass through the longitudinal axis 6 of tubular member 2. Transverse bores 8 also pass through the longitudinal axis 6 and are displaced 90 degrees from transverse bores 4. Transverse bores 10 also pass through the longitudinal axis 6 of tubular member 2 and are displaced 45 degrees from transverse bores 4. Tubular member 2 thus has throughbores relative to each other at 0 degrees, 45 degrees and 90 degrees.

Tubular member 2 is made of a rigid material such as plastic which is both lightweight and sturdy. The particular diameter of tubular member 2 and the particular length of tubular member 2 may be varied to suit the needs of the intended user.

FIG. 2 discloses a tubular member 12 similar to tubular member 2 disclosed in FIG. 1, however, it has transverse bores disposed along the length thereof at 30 degrees, 60 degrees and 90 degrees as shown by transverse bores 14, 16, 18 and 20 respectively.

FIG. 3 discloses a rod 22 of tubular construction having a recessed threaded portion 24 at each end. While the rod 22 is preferrably of tubular construction, it may, of course, be solid in construction. The diameter of rod 22 is less than the diameter of transverse bores 4, 8, 10, 14, 18, and 20 disclosed in FIGS. 1 and 2. Thus, rod 22 may be inserted through the transverse bores and secured therethrough by the insertion of bolt 26 disclosed in FIG. 9.

Bolt 26 is disclosed in FIG. 9. It has a hexigonial head 28 with a recess 30 therein for receiving a screwdriver should one desire to use a screwdriver as opposed to turning the bolt with one's hands. Threads 32 are provided along the shank of the bolt and have a pitch conforming to the pitch of the recessed threaded portions 24 of rod 22 disclosed in FIG. 3.

After a rod 22 has been inserted through a transverse bore of tubular members 2, the bolt is screwed into the recessed portion 24 of rods 22 to prevent that end of the rod from being removed from tubular member 2 or 12.

Figure 4:
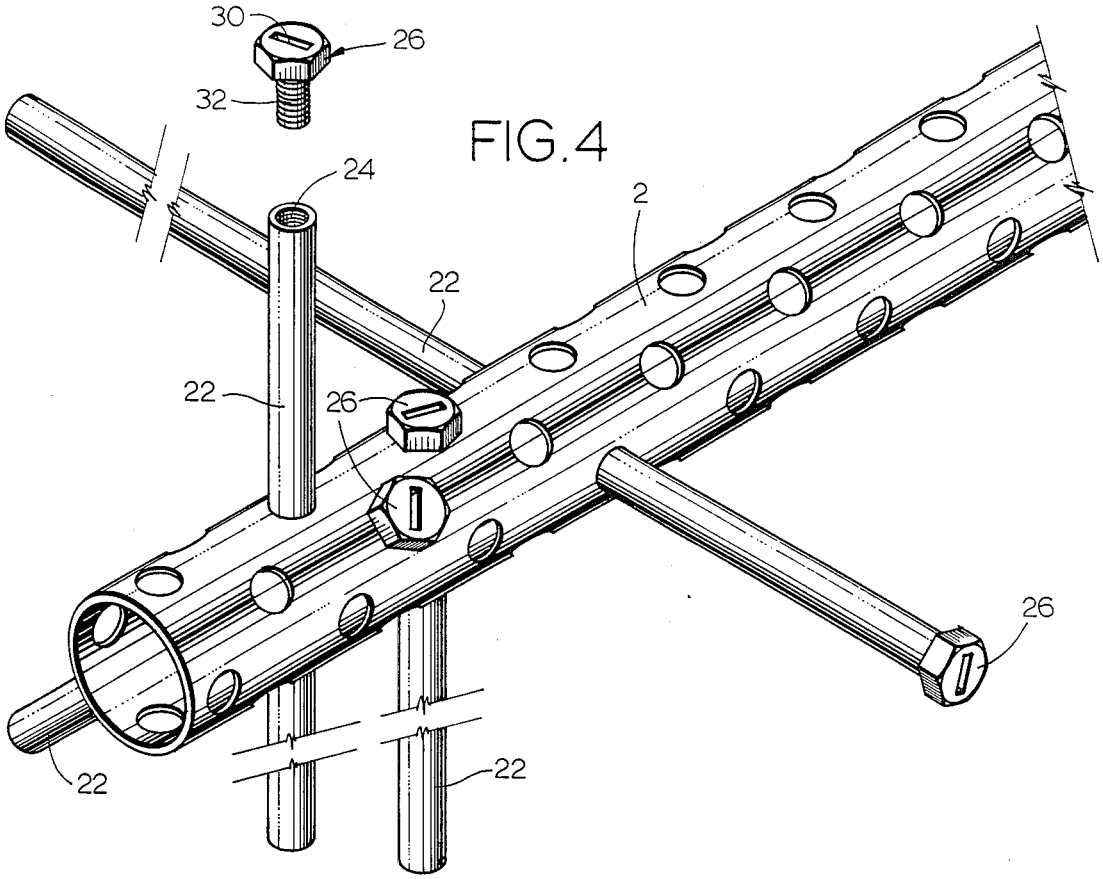
FIG. 4 is a perspective view of a tubular support memter having a plurality of the rod-like structural members inserted therethrough.

Referring now to FIG. 4, a plurality of rods 22 are disclosed inserted into tubular members 2 or 12. The particular angle and location of the rods are determined by the placement of the respective rod into a transverse bore having the location and/or angle desired. The tubular support members may have, as previously discussed, transverse bores disposed at varying angular and linear displacements limited only by the imagination or desire of the user.

Figure 5A:
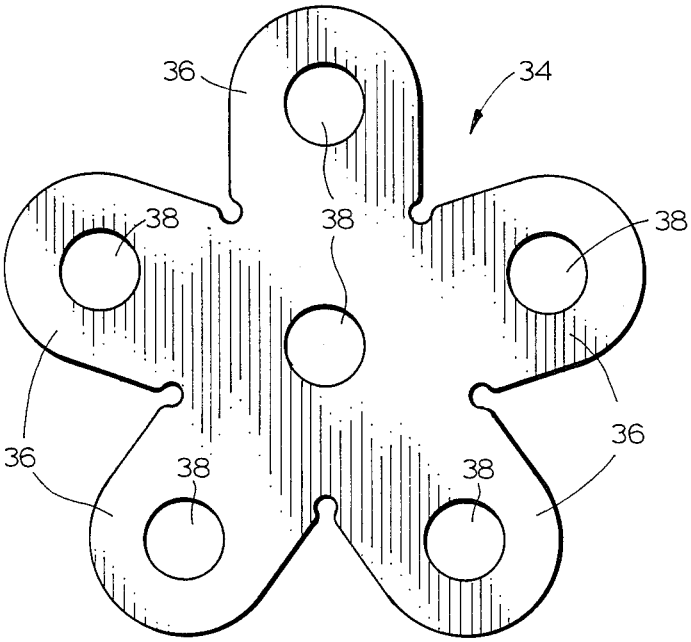
FIG. 5(*a*) discloses a star connector of deformable plastic having a plurality of flanges or ears each of which has a circular opening therethrough.
Figure 5B:
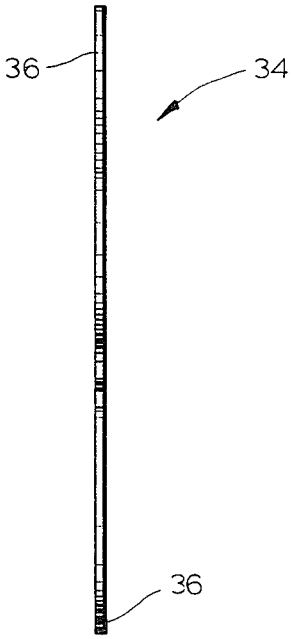

FIG. 5(*a*) disclosed a top view of what is referred to as a star connector; FIG. 5(*b*) is a side view. This particular structural member is made of deformable plastic. Star connector 34 is a circular deformable planar plastic member which has a plurality of flanges or ears 36 about the periphery thereof. Each flange or ear has a circular opening 38 therethrough. There is also a circular opening 38 through connector 34 at its center. The diameter of circular openings 38 are smaller than the diameter of rods 22 such that the rod 22 will not pass through the circular openings 38.

The diameter of shank or shaft 32 of bolt 26 (FIG. 9) is smaller than the diameter of circular opening 38. In use, the bolt 26 is inserted through circular opening 38 and screwed into the threaded recess portions 24 or rods 22 to thus secure the end of the rod to the connector. A plurality of rods may be joined to the connector. Since the connector is made of a deformable or pliable material, the rods may be caused to have various angular displacements relative to each other and yet be securely and firmly attached or secured to a single structural member. The rods may have varying lengths from that which maybe considered a nut to whatever one may desire.

FIG. 6 discloses a tubular member 40 having a diameter less than the diameter of tubular members 2 or 12. The general configuration of tubular member 40 is the same as the general configuration of the tubular member 2 or 12 with which it is to be used. In use, tubular member 40 is inserted internal to tubular member 2 or 12 to thus join two pieces of tubular members 2 or 12 together. Once tubular member 40 is inside the two tubular members to be joined together, a rod 22 may be inserted through the transverse bores of the tubular members to join them securely into a mating relationship. Should the user desire to merely join two pieces of, for example, tubular members 2 together while not having a rod 22 extending therefrom, he may select a rod having a length commensurate with the diameter of tubular member 2 and insert it through tubular member 2 and then screw a bolt 26 into both threaded portions 24 at the ends of rod 22.

Figure 7:
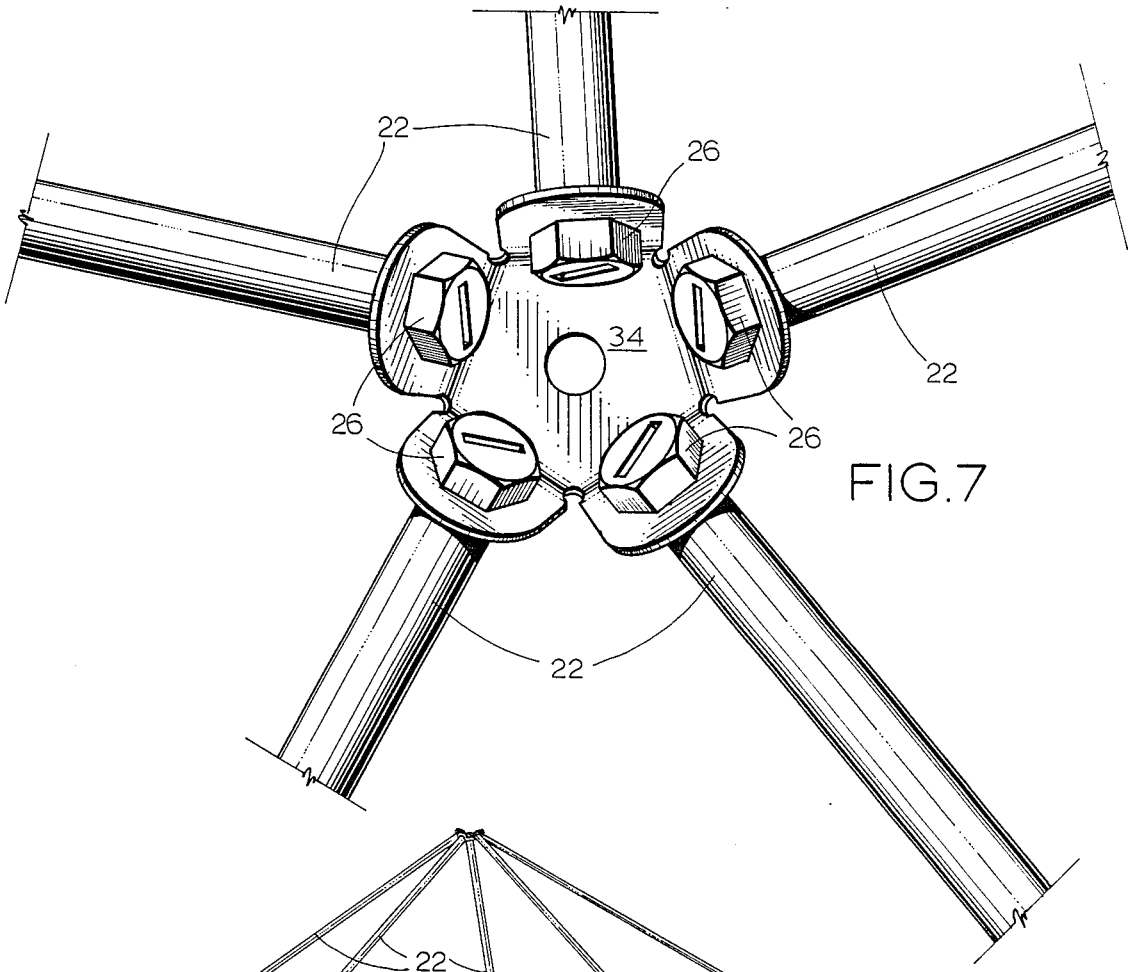
FIG. 7 discloses a geodesic structure formed from rods and star connectors.

FIG. 7 is a detailed view of star connector 34 having a plurality of rods 22 secured thereto by bolts 26. As can be seen from this detail, rods 22 may eminate from the connector at varied angles to permit the user to form geometric configurations not available with state-of-the-art toys. The rods are not limited to planar array but enjoy the ability to dispose themselves in a three-dimensional array are totally unrelated angles. The flanges or ears are capable of being rotated or twisted up and down and from side to side.

Figure 8:
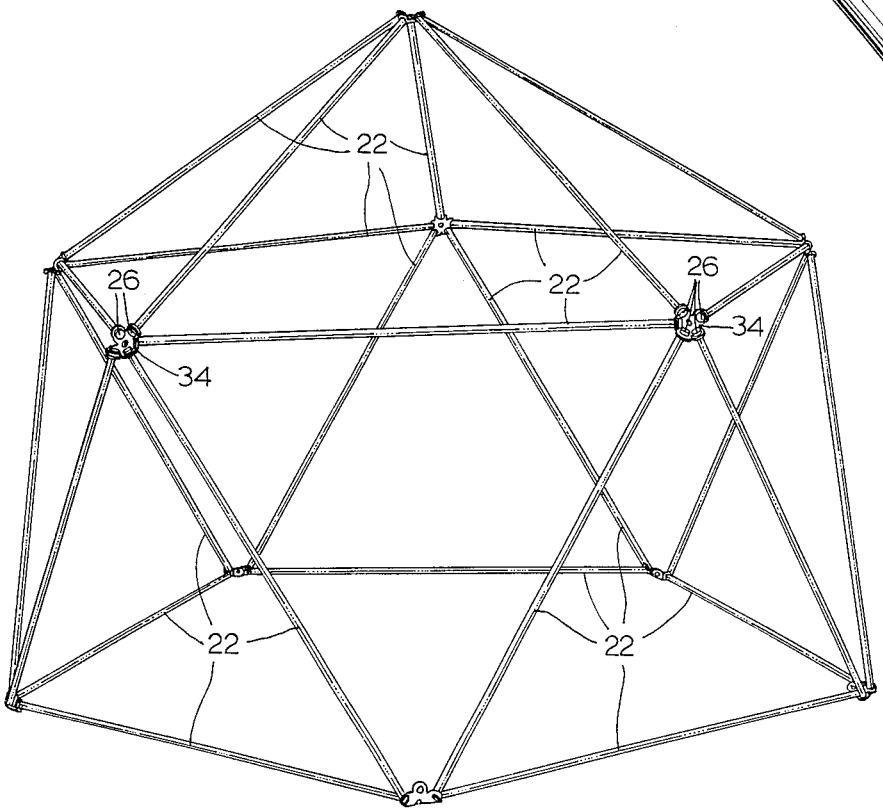
FIG. 8 is a detailed perspective view of an array of rods joined to a star connector as disclosed in FIG. 7.

FIG. 8 discloses a geodesic configuration of rods 22 joined together through the use of connector 34. The detail view of the connector shown in FIG. 7 can be seen at various junctures in FIG. 8. The flexible use of connector 34 can readily be appreciated from FIG. 8 wherein not all of the flanges of a connector need be used at any one time. It should be noticed that the central opening in connector 34 is not shown in use in FIG. 8; however, it is used as disclosed in FIG. 10 at 50.

Figure 10:
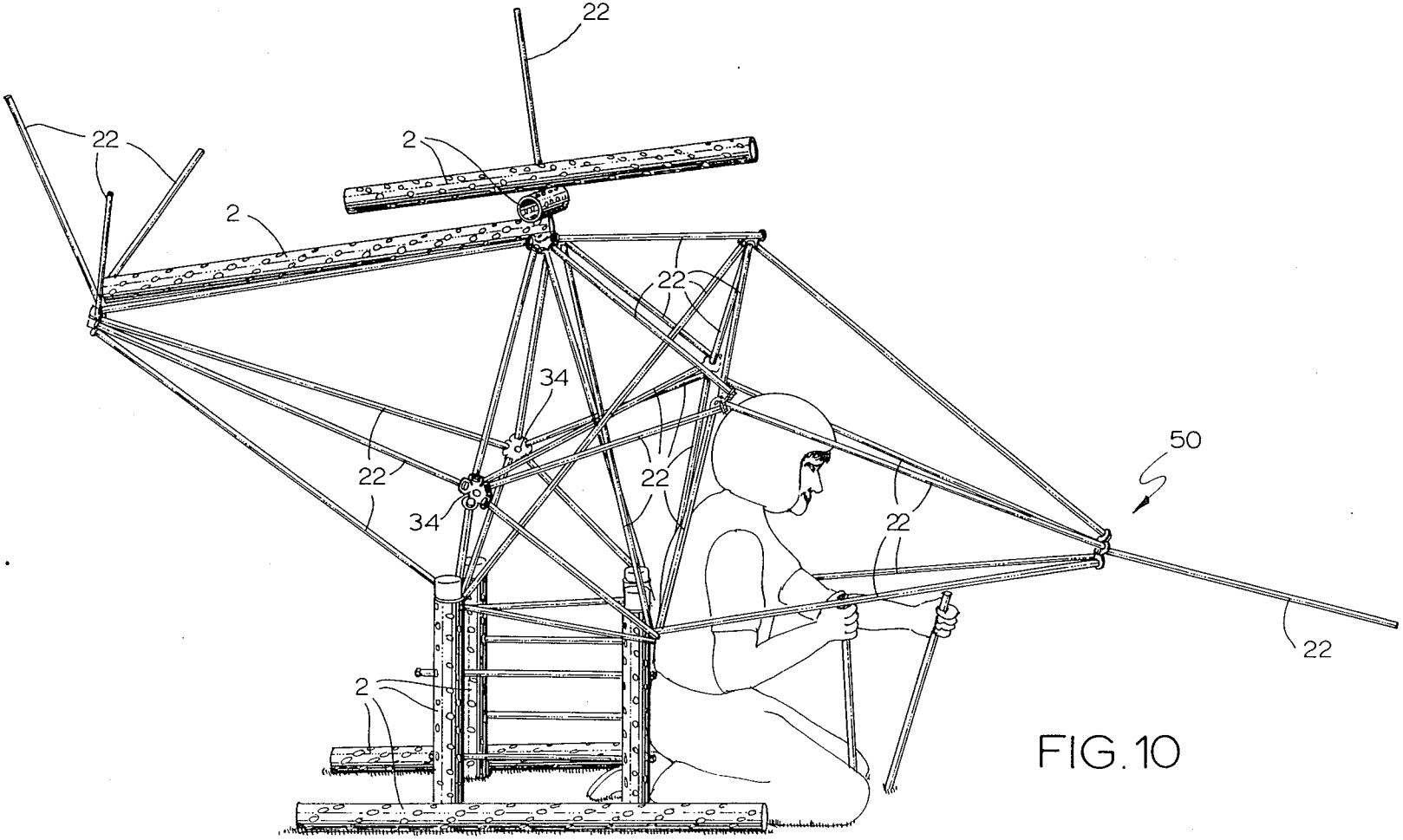
FIG. 10 discloses a perspective view of a perferred embodiment of the present invention utilizing the various structural elements comprising the present invention.

FIG. 10 discloses a perspective view of a structure made from the use of the various elements of the present invention. This Figure is intended to demonstrate the various uses of the connector, the rods and the tubular support members in what is then an unitary structure.

It may be readily seen from the above discussion of the embodiments shown that a practically inexhaustible number of play equipment forms may be constructed from the elements of this invention. The practically limitless possibilities of play apparatus construction permits the users to construct their own equipment in any ingenious fashion they desire. The structure is so simple that a group of people can easily assemble a device of their choosing in a relatively short period of time yet result in an extremely durable and sturdy type of play apparatus construction. The advanatages presented by this type of structure, of course, make its application to public playgrounds and schoolyards extremely desirable. The sturdy and aesthetically pleasing structures which result from use of this invention, furthermore, are desirable for public facilities due to their low cost and durability. Many other uses for the apparatus disclosed herein will be readily apparent to one skilled in the art.

The elements of this invention need not by cylindrical but may be square, triangular or irregular in cross sections. However, the cylindrical shape adds to the invention from the aesthetic point of view and has certain advantages in production as well as being more challenging to the developing physical abilities of participants. In addition, round members provide a more comfortable and safe play apparatus than square timbers or members since no flats and sharp edges are present.

Many other modifications within the scope and spirit of this invention will be readily apparent to those skilled in the art.

What is claimed is:

1. A take-apart toy structure comprising in combination:

a. A plurality of first elements of substantially equal length and of equal cross-section, each said first element comprising a tubular member having a plurality of transverse bores;

b. a plurality of second elements each consisting of a rod having threaded portions at each end and each having a diameter less than the diameter of said bores;

c. a plurality of bolts having heads whose diameter is greater than the diameter of said bores and having threaded portions adapted for mating relationship with the threaded portions of said second elements; and d. a third element comprising a circular deformable planar member having a plurality of circular ears about its periphery each having a circular opening at each end and which member has a circular opening at its center, each said opening having a diameter which is less than the diameter of said rod and larger than the diameter of said threaded portion of said bolt, wherein a plurality of said second elements are inserted through said transverse bores of said first elements and secured therethrough by bolts secured to the threaded ends of said second elements, wherein a plurality of said second elements are secured to a said third element by bolts passing through said circular openings in said ears of said third member and secured to the threaded ends of said second elements, said plurality of second elements being disposed at a plurality of different angular displacements to said third element, and wherein said third element is secured to a said first element by a bolt passing through said center opening of said third element and to a said second element disposed through a transverse bore of said first element.

2. A take-apart toy structure as set forth in claim 1 to further comprise in combination:

a fourth element consisting of a tubular member having a plurality of transverse bores spaced along its length and about its periphery and having an outside diamter less than the inside diameter of said first elements, whereby said fourth element is inserted into a first end of a first said element and a first end of a second said first element and a said second element is inserted through conforming transverse bores of said first elements and said fourth element to effect a joining together of said first elements and said fourth element into an unitary member, and wherein the first end of said first of said third element and the first end of said second of said third element abut.

3. A take-apart toy structure as set forth in claim 1 wherein said structure further comprises a plurality of said third elements and wherein a plurality of said second elements have a said third element connected to each end thereof.

4. A take-apart toy structure as set forth in claim 3 to further comprise in combination:

a fourth element consisting of a tubular member having a plurality of transverse bores spaced along its length and about its periphery and having an outside diameter less than the inside diameter of said first elements, whereby said fourth element is inserted into a first end of a first said first element and a first end of a second said first element and a said second element is inserted through conforming transverse bores of said first elements and said fourth element to effect a joining together of said first elements and said fourth elements into an unitary member wherein the joined ends of said first elements abut each other.

5. A take-apart toy structure as set forth in claim 4 wherein said plurality of transverse bores in said first element are symetrically displaced along the length of said first element and radially about the periphery of said first element, each said bore being radially displaced from its juxtaposed bore by 30 degrees.

6. A freestanding array of a plurality of structural units forming a rigid three dimensional apparatus, each of said units comprising:

at least one tubular member having a plurality of throughbores;

at least one rod member inserted into one or more of said throughbores;

at least one circular planar member having a plurality of circular ears about the periphery thereof, each said ear having a circular opening therethrough whose diameter is less than the diameter of said rod and wherein said circular planar member has a circular opening through its geometric center; and means for securing said rod members to said circular planar member through said circular openings thereof comprising a plurality of bolts having heads whose diameters are greater than the diameters of said openings through the said circular planar member and wherein said rod members have internally threaded ends for receiving the threaded portion of said bolts and wherein said throughbores of said tubular members have a diameter greater than the diameter of said rod members and less than the diameter of said head of said bolt and, wherein said rod members form a varied array from said circular planar member in a plurality of various obtuse or acute configurations.

7. A take-apart toy structure comprising in combination:

a. a plurality of first elements each consisting of a rod having internally threaded portions at each end;

b. a plurality of second elements each consisting of a circular deformable planar member having a plurality of circular ears disposed about the periphery thereof, each said ear having a circular opening therethrough whose diameter is less than the diameter of said first elements, each said second element having a circular opening at its center; and c. a plurality of bolts having heads whose diameters are each greater than the diameter of said circular openings of said second elements and having threaded shanks, each having a diameter that is less than the diameter of said circular openings, d. a plurality of third elements each consisting of tubular members having a plurality of transverse bores spaced along their length and about their periphery, wherein a plurality of said first elements are inserted into said transverse bores of said third elements, and wherein a plurality of said second elements are secured to a plurality of said third elements by bolts passing through said circular openings of said second elements and secured to the threaded ends of said first elements, a plurality of said first elements disposed in a plurality of different radial directions relative to each other.

8. A take-apart toy strucuture as set forth in claim 7 to further comprise in combination:

a fourth element consisting of a tubular member having a plurality of transverse bores spaced along its length and about its periphery and having an outside diameter less than the inside diameter of said third elements, whereby said fourth element is inserted into a first end of a first said third element and a first end of a second said third element and a said first element is inserted through conforming transverse bores of said third elements and said fourth element to effect a joining together of said third elements and said fourth element into an unitary member, and wherein the first end of said first of said third element and the first end of said second of said third element abut.

* * * * *